United States Patent [19]

Slifer, Sr. et al.

[11] Patent Number: 4,934,765

[45] Date of Patent: Jun. 19, 1990

[54] FURNITURE WHICH MAY BE ASSEMBLED WITHOUT TOOLS AND CORNER-HINGE THEREFOR

[76] Inventors: Richard L. Slifer, Sr.; Richard L. Slifer, Jr., both of 10550 Rhodesia Ave., Sunland, Calif. 91040

[21] Appl. No.: 225,745

[22] Filed: Jul. 29, 1988

[51] Int. Cl.[5] ..... A47B 43/00

[52] U.S. Cl. ..... 312/258; 312/263; 312/348.2

[58] Field of Search ..... 312/257 R, 257 SM, 263, 312/111, 205, 330 R, 258, 348.2

[56] References Cited

U.S. PATENT DOCUMENTS

| | | | |
|---|---|---|---|
| 224,486 | 2/1880 | Spruce | 312/263 X |
| 1,023,204 | 4/1912 | Hunter | 312/287 X |
| 2,112,498 | 3/1938 | Lax | 312/263 X |
| 2,664,258 | 12/1953 | Lanier | 312/205 X |
| 3,674,328 | 7/1972 | White et al. | 312/263 |
| 3,726,579 | 4/1973 | Ullman, Jr. | 312/330 R |
| 3,874,753 | 4/1975 | Naito et al. | 312/263 X |
| 4,036,542 | 7/1977 | Courtwright | 312/263 X |
| 4,279,455 | 7/1981 | Santo | 312/263 X |
| 4,338,990 | 7/1982 | Blodee et al. | 312/257 SK |
| 4,691,486 | 9/1987 | Niekrasz et al. | 312/256 SK |

FOREIGN PATENT DOCUMENTS

| | | | |
|---|---|---|---|
| 3047532 | 7/1982 | Fed. Rep. of Germany | 312/263 |

*Primary Examiner*—Joseph Falk

*Attorney, Agent, or Firm*—Wagner & Middlebrook

[57] ABSTRACT

An improved pedestal base for beds including drawers particularly of the type which may be transported and stored in a totally flat condition and assembled by the user without the use of any tools. The base is designed so that it is adjustable to fit under the various bed sizes. It includes a pair of longitudinal rails defining drawer openings and head and foot frame members which are segmented and assembled by keys or splines. The number of segments in the head and foot frame portions defines the width of the assembled bed. The key joints are assembled merely by placing the two members to be joined together in position and slipping the keying member into the corresponding slots. Preferably a double dovetail or hour glass joiner is used. Drawers fit into the frame and are located beneath the bed proper which is sitting on top of the frame. Drawers are comprised of a front, a back, two sides and a bottom. The front, sides and back are hinged together by a novel keyed hinge and the bottom sliding in grooves provides rigidity for the drawers. Also disclosed is a novel hinge employing a flexible or plastic living hinge or the like which actually includes a pair of hinging surfaces with a relatively rigid flexure limiting section therebetween, for example, a 90° wedge. The living hinge member as said opposite edges provides some means for retaining it in a groove. A dovetail shape is particularly suitable and a single extrusion of the hinge provides a hinging member, securing means and a stop.

2 Claims, 5 Drawing Sheets

FIG. 1
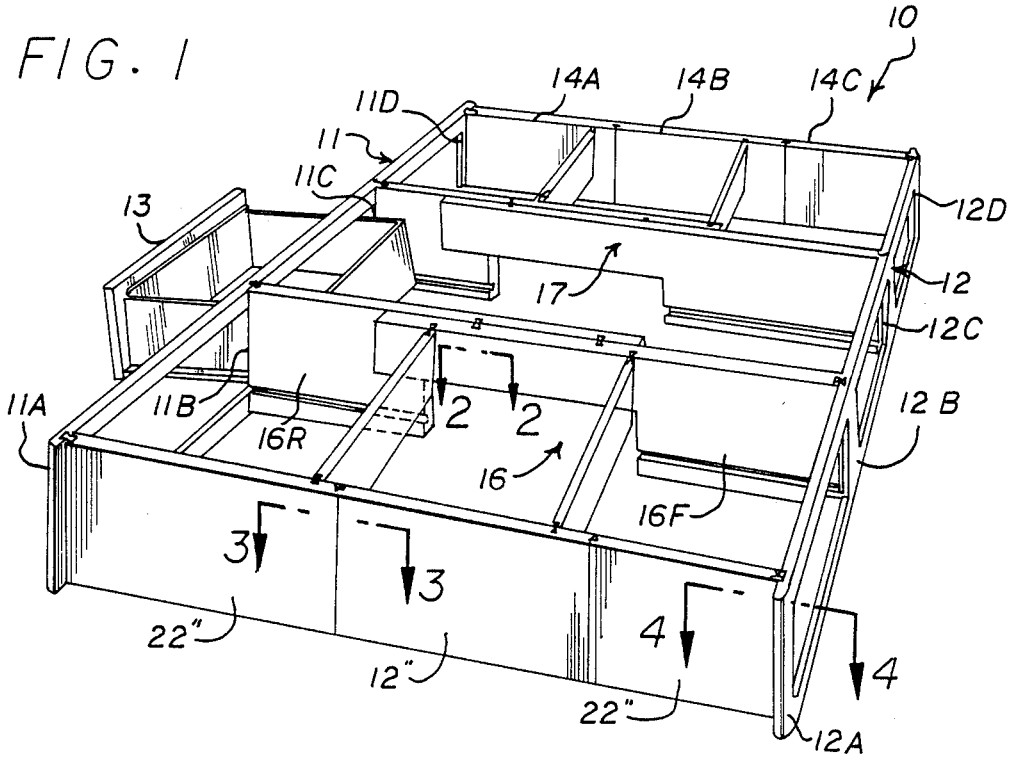
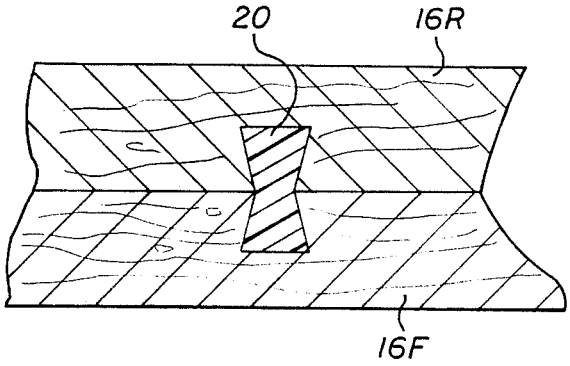
FIG. 2
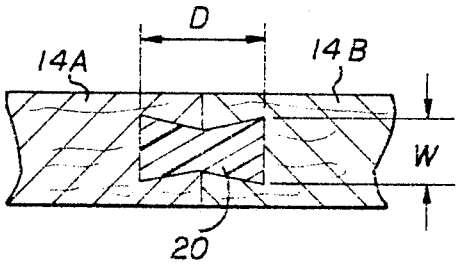
FIG. 3
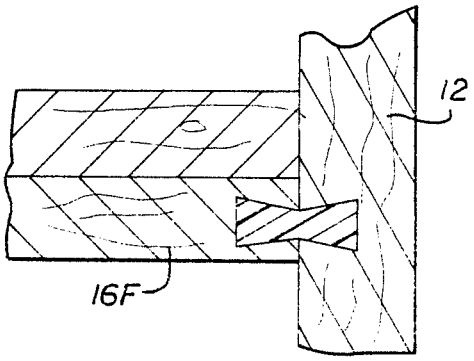
FIG. 4

FIG. 5
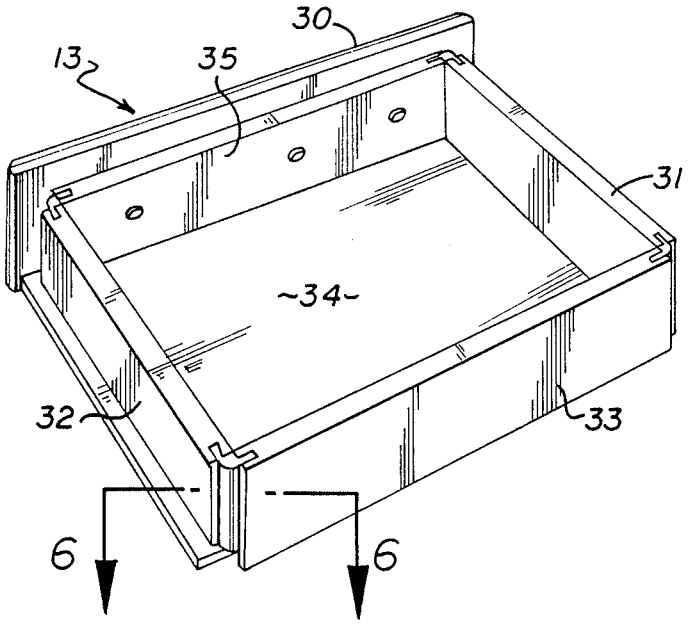
FIG. 6
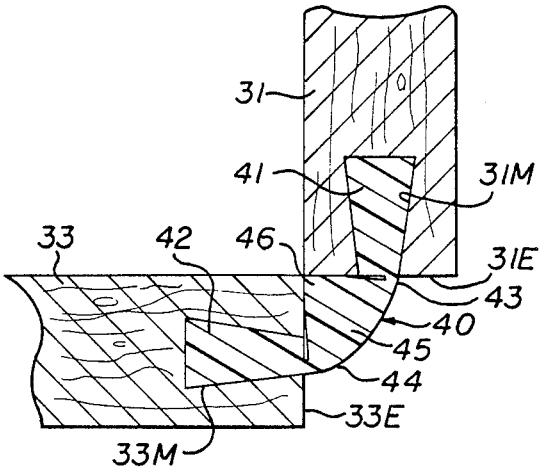
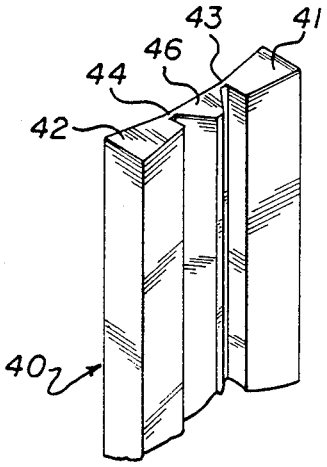
FIG. 7
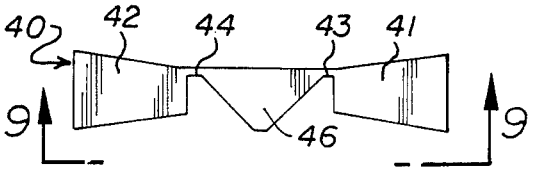
FIG. 8
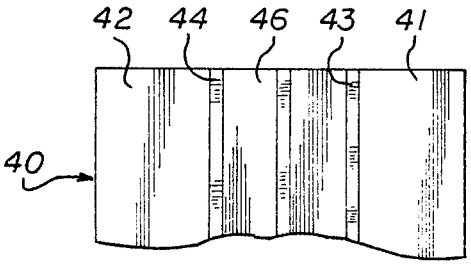
FIG. 9

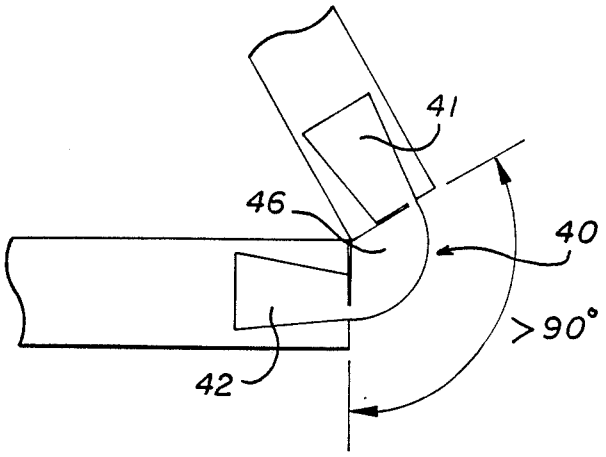
FIG. 13
FIG. 14
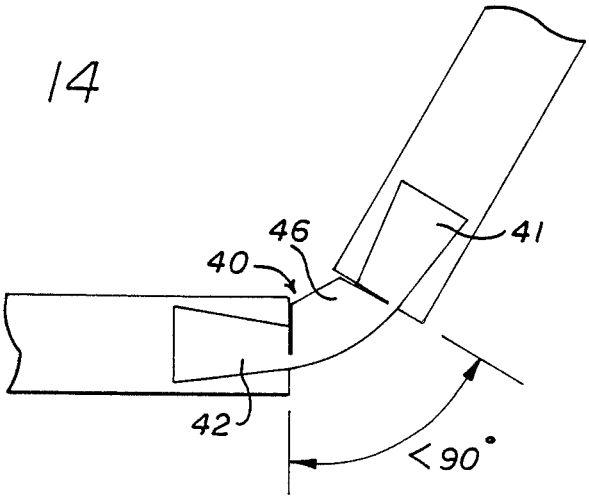
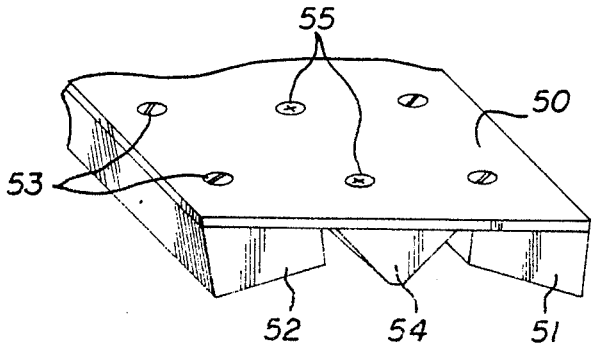
FIG. 15

FIG. 16
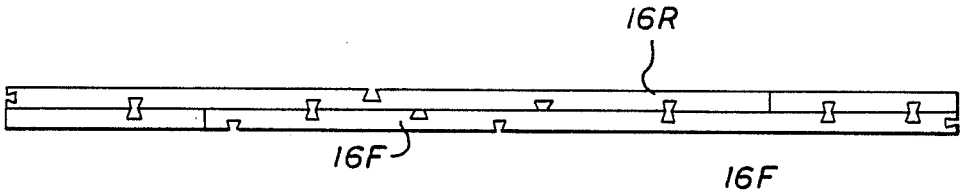
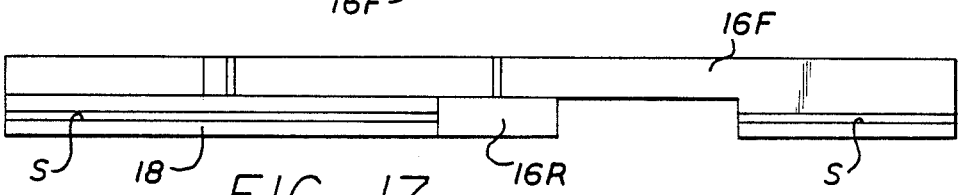
FIG. 17
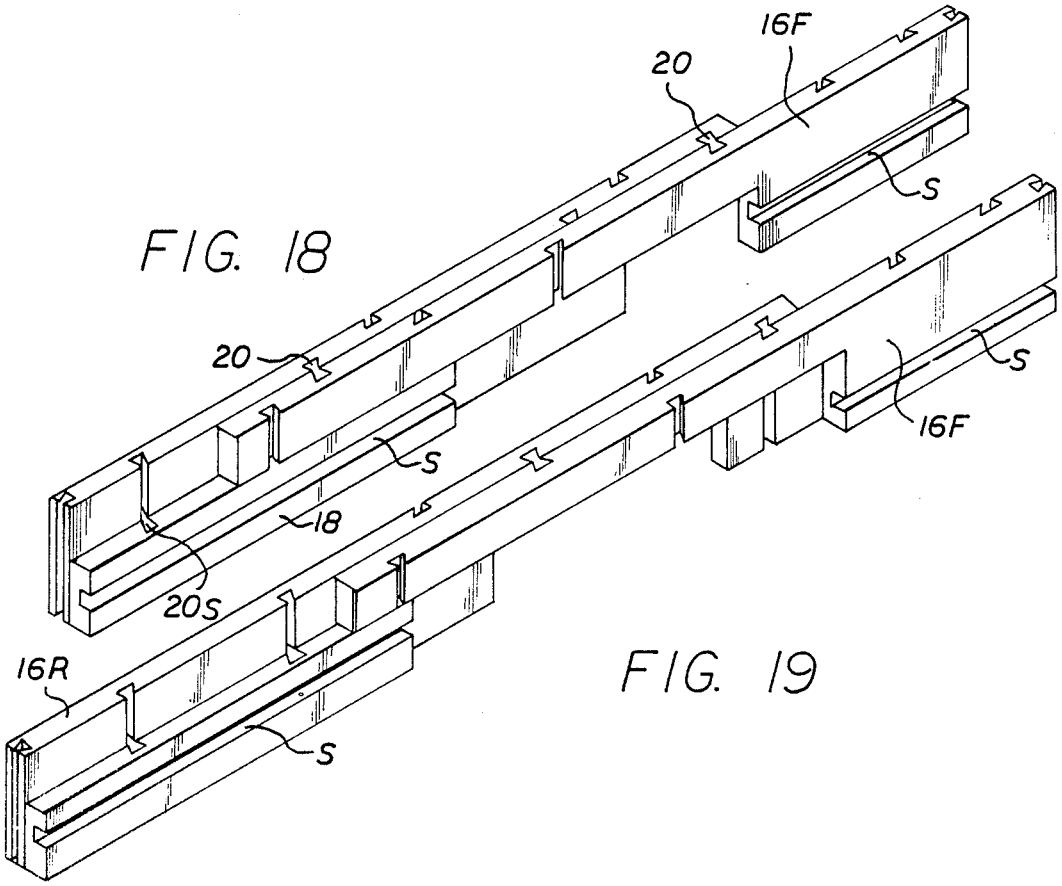
FIG. 18
FIG. 19

FURNITURE WHICH MAY BE ASSEMBLED WITHOUT TOOLS AND CORNER-HINGE THEREFOR

BACKGROUND OF THE INVENTION

The design of bed bases and their accompanying drawers has necessarily in the past involved rather massive structures, often using two inch by ten inch boards interconnected by metal latches and conventional fixed drawers. The net result has been that the bed base often has weighed one hundred pounds or more, and presents a serious logistic problem in the storage, shipment and assembly. It is advantageous for water bed manufacturers and retailers that the bed bag or bladder is easily folded into a small package but the frame itself presents a massive structure of substantial weight which must be shipped and stored.

As an additional problem, beds are commonly sold in one of three sizes, namely a large single bed, a queen size and a king size.

Various attempts have been made to produce modular furniture using removable corners and hinges. Some of these are shown in the following patents:

| | | |
|---|---|---|
| Assembled furniture | | |
| 4,003,535 | Jan. 8, 1977 | Tianchon |
| 4,169,639 | Oct. 2, 1979 | C. Zola |
| 3,695,702 | Oct. 3, 1972 | J. F. Ingellis |
| 3,545,625 | Dec. 8, 1970 | D. G. MacMillan |
| 4,067,161 | Jan. 10, 1978 | E. G. Rensch |
| 4,066,370 | Jan. 3, 1978 | P. Van Driessche |
| 3,730,601 | May 1, 1973 | E. L. Misenheimer |
| 4,600,252 | July 15, 1986 | S. C. Barber |
| 3,661,434 | May 9, 1972 | R. Aloster |
| Hinges | | |
| Swiss 603,975 | | |
| French 1,517,445 | | |
| 4,563,381 | Jan. 7, 1986 | R. J. Woodland |
| 4,089,467 | May 16, 1978 | J. M. Makowicki |
| 3,527,283 | Sept. 8, 1970 | R. R. Butler |
| 3,092,870 | June 11, 1963 | A. R. Baer |
| Corners | | |
| 3,865,051 | Feb. 11, 1975 | Johl et al |
| 4,032,242 | June 28, 1977 | M. O. Morris |
| 3,415,406 | Dec. 10, 1978 | Habgood et al |
| 3,399,912 | Sept. 3, 1968 | P. Maspero |
| 3,810,341 | May 14, 1974 | H. Holz |
| 3,638,803 | Feb. 1, 1972 | D. C. MacMillan |
| 3,981,251 | Sept. 21, 1976 | Damberg et al |
| 3,856,147 | Dec. 24, 1974 | G. Piretti |
| 3,822,924 | July 9, 1974 | D. A. Lust |

We have found that the massive bases heretofore considered essential are unnecessary and the compressive stress of wood structure, properly designed, will support a bed of either the single, queen, or king size and may be disassembled into a small package for storage and shipment.

We have also found that with the use of interchangeable pieces, one bed base will fit any of the various sizes of beds. Therefore, a single bed frame may be manufactured, stored, sold and later converted by the ultimate purchaser to the appropriate size. Likewise, if a change of size is desired, the user may make the change without the use of any tools.

We have also found that one of the difficulties of selling any disassemble furniture in the case goods category is that drawers, by their very nature, are not normally disassemblable. We have determined that it is possible to make a drawer assembly which is capable of being shipped and stored totally flat and later easily assembled by the user without tools.

BRIEF DESCRIPTION OF THE INVENTION

This invention is related to a modular and interchangeable form of furniture construction, particularly to the base frame or pedestal for beds and providing internal drawers. The assembly comprises a pair of longitudinal face frames with apertures therein to receive drawers, for example, three on each side for a total of six drawers. The face frames extend vertically to a suitable height to raise the bed off of the floor and are interconnected by a head member, a foot member, and a pair of intermediate members, the later two which are located at vertical columns in the face frames.

Each of the head and foot members are segmented, being made up for example of a pair of members of the same height as the face frames, but of two discrete lengths, approximately 22 inches and 12 approximate inches. The queen size frame is made up of two 22 inch frame members and one 12 inch frame member. A smaller size frame employs only two 22 inch frame members in each of the head and foot frame sections and a king size bed frame employs two 22 inch frame members and two 12 inch frame members.

The head, foot, and intermediate frame members are joined by double dovetail splines, which are used to butt sections together and to make right angle corner joints between the face frames and the outer ends of the outermost frame members. These same face frames are used for each of the bed sizes. The inner faces of each of the foot, head and intermediate frame members include longitudinal grooves into which the bottom of the drawers slide to provide support for the drawers throughout their length when they are in place. The drawers themselves are de-mountable to a flat configuration as is the bed frame itself. The corners of the frame of the drawers are interconnected by novel flexible hinges which intersect the ends of the drawer frame or sides and back, are flexible and provide a stop which defines a 90° corner.

The hinges are preferably of the "living hinge" type in that they employ the elasticity of the plastic composition in a thin section as a hinge rather than any interconnecting metal parts. For this particular application, namely for drawer corners, there is little need for repeated flexing since the drawers are expected to be assembled once and stay together until the bed needs to be moved, at which time it may be disassembled if the drawers need to be disassembled but otherwise may remain unflexed throughout its life time. In any event, the materials selected provide the capability of many hundreds or thousands of cycles without failure of the hinge. Of major importance in the hinge are the facts that:

(a) the hinge includes integral stop to prevent overflexing and to define a rigid corner;

(b) provides integral securing means to the frame members to be joined at a corner and hinged;

(c) is capable of easy assembly; with no tools required; and (d) allows flat stacking of drawers for shipping and storage.

In the preferred form of this invention, a pair of flexible sections of the hinge are separated by an isosceles triangle section having its peak angle approximately equal to the joint, e.g. 90°. Outwardly, beyond the flexible sections are a pair of dovetails or truncated pyramid sections which are designed to match the keyways in the frame. Therefore, no fastening means is required employing the hinge joint of the invention and no additional stop means to limit the angle of the corner is necessary. This is all provided by the hinge itself.

Additionally, the exposed corner surface of the hinge provides an attractive contrast in material and, if desired color, from the frame. In the drawer assembly, preferably a face plate with overhang, is secured to a front frame member. The face plate may have a slot to receive the bottom of the drawer and the rear frame member preferably has a slot to receive the bottom of the drawer. The side edges of the bottom of the drawer extends beyond the side frame members to engage the corresponding slots in the bed frame.

BRIEF DESCRIPTION OF THE DRAWINGS

This invention may be more clearly understood from the following detailed description and by reference to the drawing in which: FIG. 1 is the perspective view of an assembled queen size bed frame in accordance with this invention with one drawer shown removed;

FIG. 2 is a horizontal fragmentary section showing a joint in the frame assembly intermediate member taken along line 2—2 of FIG. 1;

FIG. 3 is a horizontal fragmentary view taken along line 3—3 of FIG. 1

FIG. 4 is a horizontal fragmentary sectional view taking along line 4—4 of FIG. 1 and showing a butt joint thereof;

FIG. 5 is a perspective view of a drawer made in accordance with this invention;

FIG. 6 is a horizontal sectional view taken along line 6—6 of FIG. 5;

FIG. 7 is a perspective view of the novel hinge corner of this invention;

FIG. 8 is an end view of the hinge corner member of FIG. 7;

FIG. 9 is a fragmentary front elevational view of the hinge corner of FIGS. 7 and 8;

FIG. 13 is a top plan view of an alternate embodiment of the flexible hinge of this invention;

FIG. 14 is a top plan view of still another embodiment of the hinge of this invention;

FIG. 15 is a perspective view of a composite flexible hinge embodiment of this invention;

FIG. 16 is a top plan view of an intermediate support frame member adjusted to queen size;

FIG. 17 is a front side elevational view of the intermediate frame member of FIG. 16;

FIG. 18 is a perspective view of the intermediate frame member of FIGS. 16 and 17; and FIG. 19 a perspective view of the intermediate frame member of FIGS. 16–18 adjusted to king size.

DETAILED DESCRIPTION OF THE INVENTION

Figure 10:
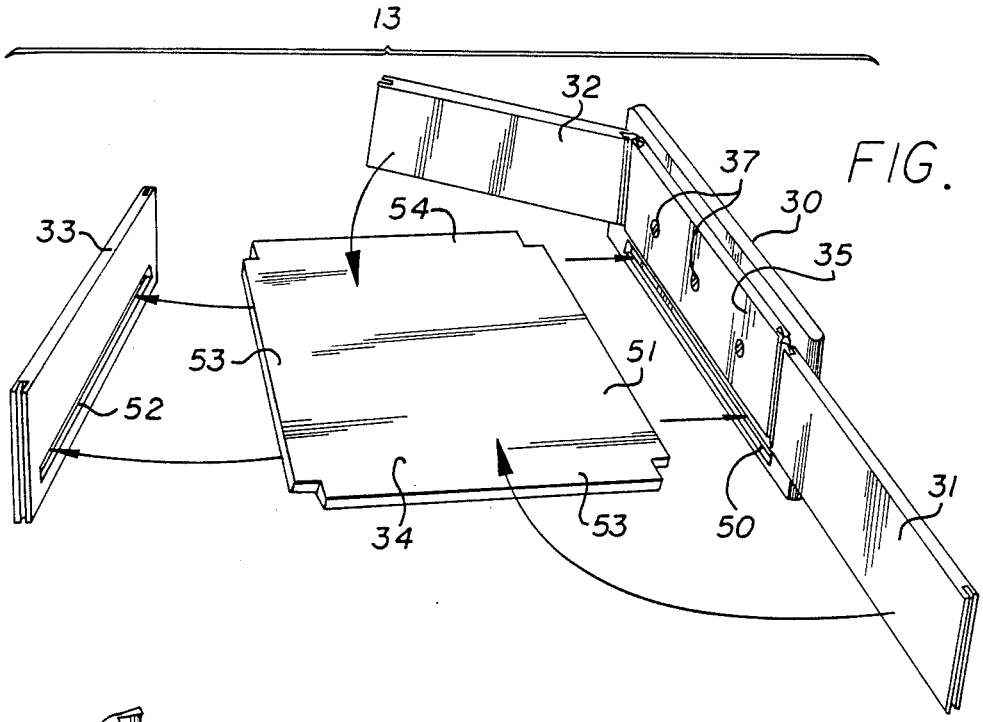
FIG. 10 is a partly exploded view of the drawer of FIG. 5.

Now referring to FIG. 1 in conjunction with FIGS. 2, 3 and 4, a queen size bed frame 10 is illustrated including a pair of face frames 11 and 12 each of which include three rectangular openings designed to receive a drawer such as drawer 13. The face frames ideally have four vertical column members 11 A & 12 A, 11 B & 12 B, 11 C & 12 C and 11 D & 12 D. The two face frames 11 and 12 are joined by a head frame member 14, a foot frame member 15, and a double width pair of intermediate frame members 16 and 17 in telescoping arrangement. Each of these frame members, 14 through 17 are formed of segments and butt joined at their intermediate junctions and Joined at the edges where they meet the face frames 11 and 12. For example, the head frame member 14 includes a pair of sections 14 A and 14 C, each of which are preferably 22 inches long and an intermediate section 14 B which is 12 inches long. Butt joints are formed employing double dovetail shaped longitudinal mortise grooves in the edges and held by double dovetail splines such as spline 20 of FIGS. 2, 3 and 4.

As illustrated in FIG. 1, and better seen in FIGS. 16–19, to which reference is also made, the intermediate supports 16 and 17 are of double thickness employing, for example, two ¾ inch thick boards having the same total length as the head and foot frames but and have a plurality of splines 20 located in adjacent faces of the intermediate support boards so that the two boards are splined together provide 1½ inch nominal thickness in the central section of the frames. They are telescoped together, in effect, at various lengths which correspond to standard bed sizes for an underlying pedestal. This is illustrated in FIG. 2 and in FIGS. 16–19 in which the frame member 16 is made up of 16, front, identified as 16 F and 16, rear, identified as 16 R joined at their adjacent faces by the splines 20.

A similar spine 20 is used to make the butt joint between the frame members 14 through 17 and the face members 12 as shown in FIGS. 1 and 4.

Note in FIGS. 17–19 that in the outer faces of both intermediate supports 16 and 17 and the inner faces of the head and foot supports 14 and 15, there is a longitudinal slot S corresponding in position to the bottom of the rectanglar openings in the face frames 11 and 12. These longitudinal slots S provide guide ways for the drawer 13 and its counterparts for sliding the drawers in and out and to provide support for the drawers throughout their lengths.

Referring specifically to FIGS. 16–19, the intermediate frame members 16 F and 16 R may be seen as generally L shaped, laid on their sides with four dovetail slots on their adjacent faces and one each on the ends which are the foot of the L. The latter dovetail slots are used to butt join with face frames 11 and 12. The foot portions of the L shaped intermediate frames also have drawer slots S in their remote or outer faces. In order to provide a corresponding drawer slide at the ends of the L shaped intermediate frame members, additional slotted rails 18 are provided. The rails 18 are secured to their respective intermediate frame 16F or 16R by a pair of splines 20, one the regular spline 20 joining that end region of the adjacent faces of frame members 16F and 16R and by a shorter spline 20S.

Two pair of short longitudinal reinforcing rails 27 and 28, appearing in FIG. 1 complete the pedestal base frame 10. These are similarly splined in butt joints to the transverse frame members.

Referring specifically to FIGS. 2, 3, and 4 may be seen there in that the double dove-tail spline 20, is usable in three different modes, (1) to make a planar joint between the front and rear boards or direction members 16F and 16R, (2) to make butt joints as shown in FIG.

3 between members 14A and 14B and (3) to make T joints as between the double width members such as 16 F and either face plate 11 or 12. The splines 20 have a length equal to the height of the assembled frame or slightly less and in a preferred embodiment a depth D in the order of three-quarters of an inch and a width of the tail portion W in the order of one-half of an inch. This allows the spline 20 to be used in a single three-quarter inch width board to provide a joint without danger of fracturing the wood. The splines 20 may be of wood or extruded plastic or any other rigid or semi-rigid material such as Elastolene 50D of Monsanto of St. Louis, Mo., and extruded by Kirkhill Rubber Company of Brea, CA. THE DISASSEMBLABLE DRAWER.

Now referring to FIG. 5, in conjunction with FIG. 6, a typical drawer 13 is illustrated in perspective as including a front or face-plate 30, a pair of sides 31 and 32, a back 33, and bottom 34. The front 30 may include an inner front 35. The drawer 13 includes corner joints of the type illustrated in FIG. 6 as between the side 31 and the back 33. The edges 31E and 33E each include a dove-tail mortise 31M and 33M extending preferably from top to bottom throughout the side and back 31 and 33. Positioned in the mortises 31M and 33M and defining the corner is a flexible corner joint member 40 having a pair of end attachment portions 41 and 42, a pair of flexible hinge portions 43 and 44 adjacent to the attachment portions 41 and 42 and a flexure limiting portion 45 preferably in the form of a isosceles triangle with an included angle 46 between the two equal sides of 90 degrees where a right angle corner is desired.

If a corner of less than ninety degrees is desired, the included angle 46 is larger then 90 degrees and if the corner angle is desired to be greater than 90 degrees, the included angle is less than 90 degrees. These relationships are illustrated in FIGS. 13 and 14. The stop portion 46 is preferably truncated at its top. Small truncation is visible in FIGS. 6, 7 and 8. For corners having a desired angle of less than ninety degrees the truncation may be small or disappear as shown in FIG. 13 while in the case of corner angles greater than ninety degrees, as shown in FIG. 14 the truncation is large and approaches the width of the base.

In the preferred embodiment as shown in FIGS. 6–9, the flexible member is unitary and made of plastic material such as Elastolene 50, identified above.

Since the attachment portions 41 and 42 as well as the stop member 46 are rigid in their intended functions, these may be separable and secured to a thin flexible sheet 50 as illustrated in FIG. 15. The attachment portions 51 and 52 may be secured by adhesive or countersunk screws 53. The flexure limiting stop 54 is similarly secured by adhesive or ornamental screws 55. These ornamental screws or fasteners are used since they do appear in the final assembly.

Figure 12:
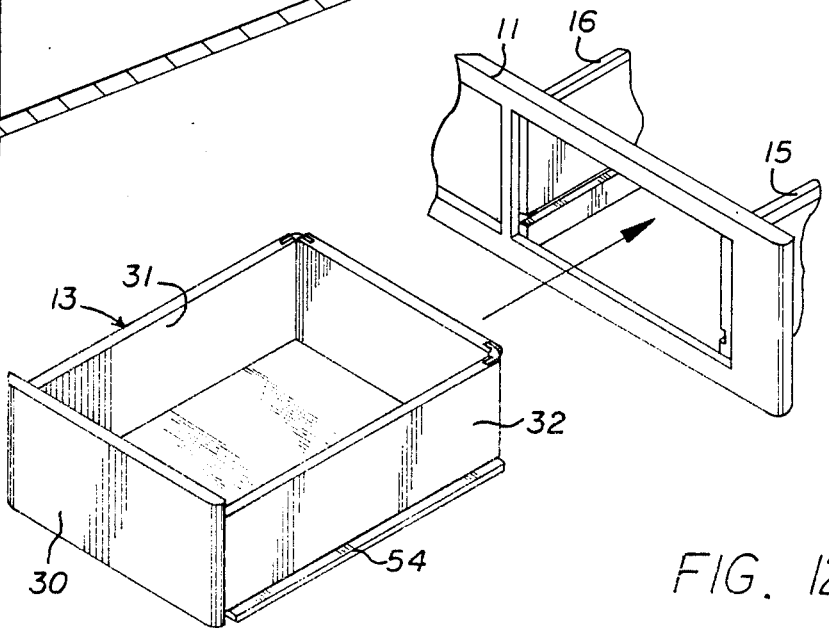
FIG. 12 is a perspective view of the drawer removed from the frame which is shown in the fragmentary perspective.

Now refer to FIG. 10 for an understanding of the assembly of the drawer 13. The face-plate or front 30 is shown with its back plate 35 permanently secured by adhesive or fasteners 37. Face-plate 30 includes a groove 50 below the backing plate 35 which is designed to receive a front tang 51 of the bottom 34 to hold the bottom 34 in place and provide support along the front of the drawer. The drawer back 33 also includes a slot 52 assigned to receive the rear tang 53 of the bottom 34. The slots 50 and 52 are located below the level of the backing plate 35 and the sides 31 and 32. A pair of side extensions 53 and 54, best seen in FIGS. 5 and 12 extend beyond the outer face of the sides 31 and 32 to allow the drawer 13 to slide in the grooves present in the inner faces of the frame 10 of FIG. 1.

Figure 11:
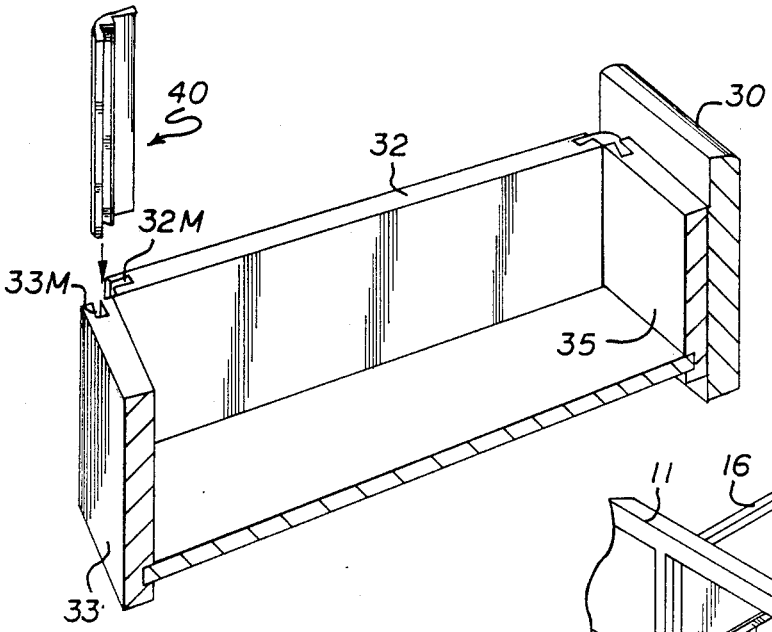
FIG. 11 is a fragmentary sectional view of the drawer of FIG. 5 with a hinge spline removed.

The sides 31 and 32 are secured to the backing plate 35 of the front 30 bY flexible corner connectors 40 as illustrated in FIG. 6. Installation of the corner connectors is as illustrated in FIG. 11 where the side 32 and the back 33 are placed in position and the flexible corner member 40 slipped downward into the mortises 32M and 33M. When partially disassembled by removing one corner hinge connector 40 the front, sides and back may be laid flat, packaged or stored.

In a typical package of this invention, ready for shipment or storage, the carton has dimensions of 5"×18"×72"(12.7 cm×45.7 cm×182.9 cm) and volume of approximately 4 cubic feet (0.1 $m^3$. This compares with prior art packages of two boxes at 9¼"×24"×72" (23.2 cm×61 cm×182.9 cm) for a volume of approximately 18 cubic feet (0.26 $m^3$).

The above described embodiments of the present invention are merely descriptive of its principles and are not to be considered limiting. The scope of the present invention instead shall be determined form the scope of the following claims including the doctrine of equivalents.

What is claimed is:

1. A furniture frame having a head, a foot and sides adaptable to multiple size configurations comprising:

a plurality of ace frames constituting opposing sides of the furniture frame;

a plurality of transverse frame members for interconnecting said face frames at spaced locations and in parallel relationship to each other;

removable interconnecting means for joining the ends of said transverse frame members to said face frames at spaced locations;

said transverse frame members comprising a plurality of individual sections joinable together to define the length of said transverse frame members and the overall width of the furniture frame;

said transverse frame member sections being of predetermined length whereby the width of the furniture frame depends upon the number of individual sections joined to form each transverse frame member;

means joining said individual sections together;

said joining means being compatible with said interconnecting means whereby different numbers of said individual sections may be joined to said face frames in changing the width of the furniture frame;

including drawers having fronts, sides, backs and bottoms for insertion into the openings defined by said face frames;

said drawers including removable corners and bottom whereby said drawers may be disassembled into a generally flat package;

wherein said removable corners comprise flexible splines engaging the ends of the front, sides and back of said drawers;

wherein said flexible splines include integral means for securing said splines to adjacent edges defining said corners and including integral means for limiting the extent of flexing in at least one direction; and wherein said integral means for limiting the extent of flexing of said flexible splines comprises an angular enlargement having an included angle approximating the angle of the corner formed by the splines with adjacent edges defined the corners.

2. A four sided container capable of being disassembled into a flat package comprising:

a front, a back, a pair of sides and a bottom;

flexible means for securing the corners of said front and sides and the back and sides to form a hollow frame, said flexible means comprising a spline having two discrete flexible portions separated by an angular enlargement dimensioned to defined the maximum degree of flexure of the flexible portions in one direction;

said flexible means further including attachment portions extending laterally beyond said discrete flexible portions for securement to adjacent edges of respective sides and front or rear of the container;

means securing the bottom to said container;

wherein said flexible means comprise elongated strips of plastic material having a cross section containing the flexible portions, angular enlargement and attachment portions.

* * * * *